US009296575B2

(12) United States Patent
Juan et al.

(10) Patent No.: US 9,296,575 B2
(45) Date of Patent: Mar. 29, 2016

(54) PICKUP MECHANISM

(71) Applicant: Foxlink Image Technology Co., Ltd., New Taipei (TW)

(72) Inventors: Chun Chia Juan, New Taipei (TW); Te You Chu, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 19 days.

(21) Appl. No.: 14/228,997

(22) Filed: Mar. 28, 2014

(65) Prior Publication Data

US 2015/0274453 A1 Oct. 1, 2015

(51) Int. Cl.
*B65H 3/06* (2006.01)
*B65H 3/34* (2006.01)

(52) U.S. Cl.
CPC ..... *B65H 3/0684* (2013.01); *B65H 3/0607* (2013.01); *B65H 3/34* (2013.01); *B65H 2402/543* (2013.01); *B65H 2403/41* (2013.01)

(58) Field of Classification Search
CPC .... B65H 3/063; B65H 3/0684; B65H 3/0676; B65H 3/0669; B65H 5/068; B65H 2402/32; B65H 3/0607
USPC ..... 271/131, 138
See application file for complete search history.

(56) References Cited

U.S. PATENT DOCUMENTS 8,708,332 B2 * 4/2014 Cheng ..... 271/138
8,894,062 B1 * 11/2014 Chen et al. ..... 271/137

* cited by examiner

*Primary Examiner* — Michael McCullough
(74) *Attorney, Agent, or Firm* — WPAT, P.C., Intellectual Property Attorneys; Anthony King

(57) ABSTRACT

A pickup mechanism includes a mechanical frame, at least one pickup roller, a paper pressing board disposed above the mechanical frame, a transmitting element, a cover covered on the paper pressing board, at least one stopper element pivotally mounted to the paper pressing board, and at least one elastic element elastically disposed between the cover and the paper pressing board. The pickup roller is disposed under the mechanical frame. The paper pressing board has a bottom board. A top of the bottom board protrudes upward to form a movable portion. A front of the movable portion defines a driven link. The transmitting element is cooperated with the driven link of the paper pressing board to bring along the paper pressing board to be pressed downward and be raised up. The cover has a top wall. A bottom of the top wall protrudes downward to form a locking part.

15 Claims, 3 Drawing Sheets

PICKUP MECHANISM

BACKGROUND OF THE INVENTION

1. Field of the Invention

The present invention generally relates to a pickup mechanism, and more particularly to a pickup mechanism capable of picking up paper steadily.

2. The Related Art

A conventional pickup mechanism generally includes a paper pressing board, a pickup assembly, at least one stopper assembly and a drive assembly. When the conventional pickup mechanism is operated, the drive assembly is needed to drive the pickup assembly by way of a cam or a connecting rod to feed paper to a scanning area. When the paper is completed scanning, the drive assembly drives the stopper assembly by way of the cam or the connecting rod to restore a status of preparing for picking up the paper so as to facilitate a user to place the paper.

However, the drive assembly drives the pickup assembly by way of the cam or the connecting rod that will increase corresponding transmission components and further increase an assembling complexity of the transmission components to increase costs of assembling space and assembling hours, and furthermore it's apt to make a down force of the left side of the paper pressing board unequal to that of the right side of the paper pressing board to cause an unbalanced down force exerted on the paper when the pickup assembly picks up the paper to generate a tilt problem of picking up paper. As a result, a stability of the pickup mechanism is affected.

So how to improve the above-mentioned problem through a structural design of the pickup mechanism has become an important issue which is needed to be solved by professional people, accordingly, an innovative pickup mechanism which has a proper structural design is needed to be provided to effectively improve the above-mentioned problem so as to make the pickup mechanism capable of picking up the paper steadily.

SUMMARY OF THE INVENTION

An object of the present invention is to provide a pickup mechanism. The pickup mechanism includes a mechanical frame, at least one pickup roller, a paper pressing board, a transmitting element, a cover, at least one stopper element and at least one elastic element. The mechanical frame defines at least one locating groove. The pickup roller is disposed under the mechanical frame and partially passed through the locating groove to project above the mechanical frame. The paper pressing board is disposed above the mechanical frame. And the paper pressing board has a bottom board. A top of the bottom board protrudes upward to form a movable portion. A front of the movable portion defines a driven link. The transmitting element is cooperated with the driven link of the paper pressing board to bring along the paper pressing board to be pressed downward and be raised up. The cover is covered on the paper pressing board. And the cover has a top wall. A bottom of the top wall protrudes downward to form a locking part. The stopper element is pivotally mounted to the paper pressing board. The elastic element is elastically disposed between the cover and the paper pressing board. The transmitting element is capable of rotating freely, the paper pressing board is pressed downward by virtue of an elastic force of the elastic element to make the pickup roller generate a normal force for picking up paper, the stopper element breaks away from a restraint of the locking part with the paper pressing board being pressed downward to make the stopper element to move freely, the paper is fed by virtue of the pickup roller rotating along a first direction and pushing away the stopper element, and when there is no paper, the transmitting element rotates along a second direction opposite to the first direction, the paper pressing board is raised up to an original position by virtue of the transmitting element bringing along the driven link of the paper pressing board, at the moment, the stopper element rotates downward to abut against the locking part of the cover to be located at a paper blocking position on account of gravity or other external forces thereof, with the paper pressing board being raised up, the paper blocking function of the stopper element is realized by virtue of the constraint of the locking part.

As described above, the transmitting element brings along the paper pressing board to be pressed downward or be raised up to make the pickup roller generate the normal force for picking up the paper or the stopper element realize the paper blocking function, comparing with the drive assembly driving the pickup assembly by way of the cam or the connecting rod in prior art, the pickup mechanism will decrease corresponding transmission components and further ensure an assembling simplicity of the transmission components to decrease costs of assembling space and assembling hours, and furthermore a balanced down force exerted on the paper when the pickup roller picks up the paper, so that the pickup mechanism has a proper structural design. As a result, a stability of the pickup mechanism is ensured.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
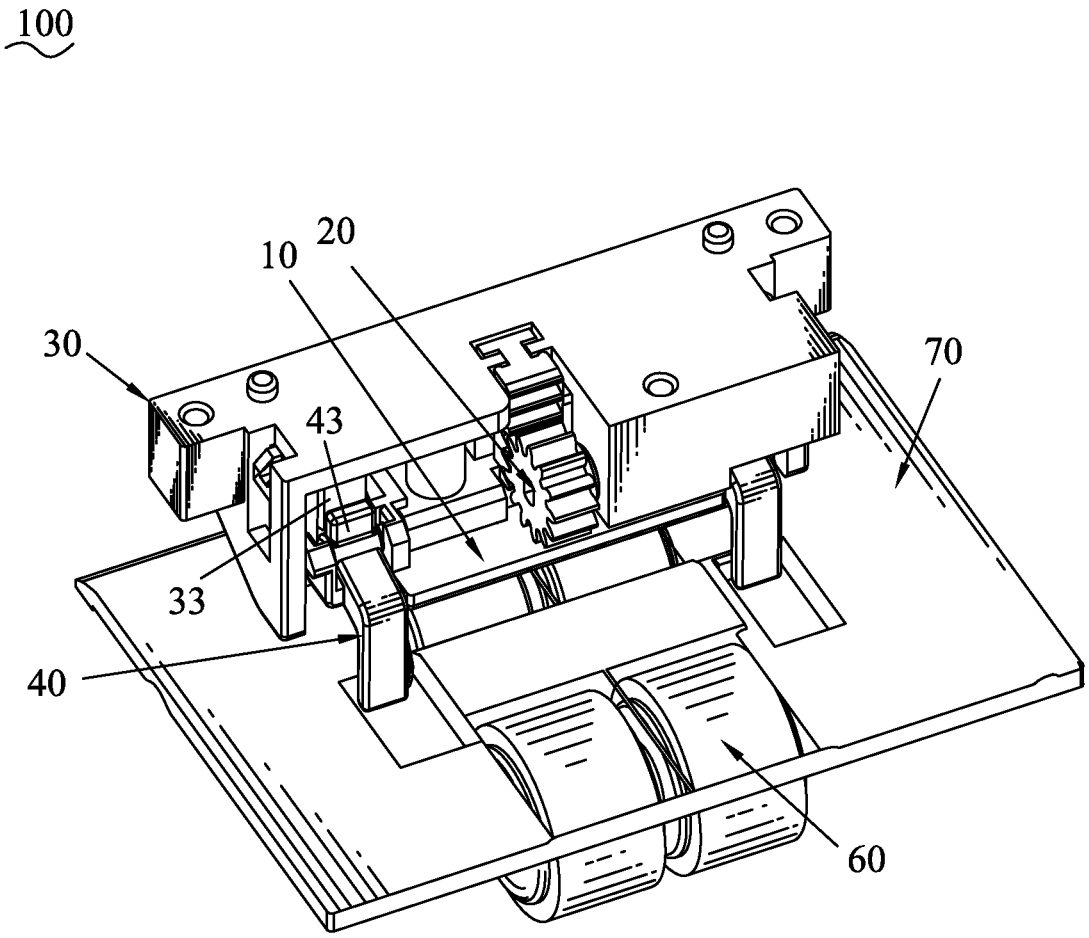
FIG. 1 is a perspective view of a pickup mechanism in accordance with an embodiment of the present invention.
Figure 2:
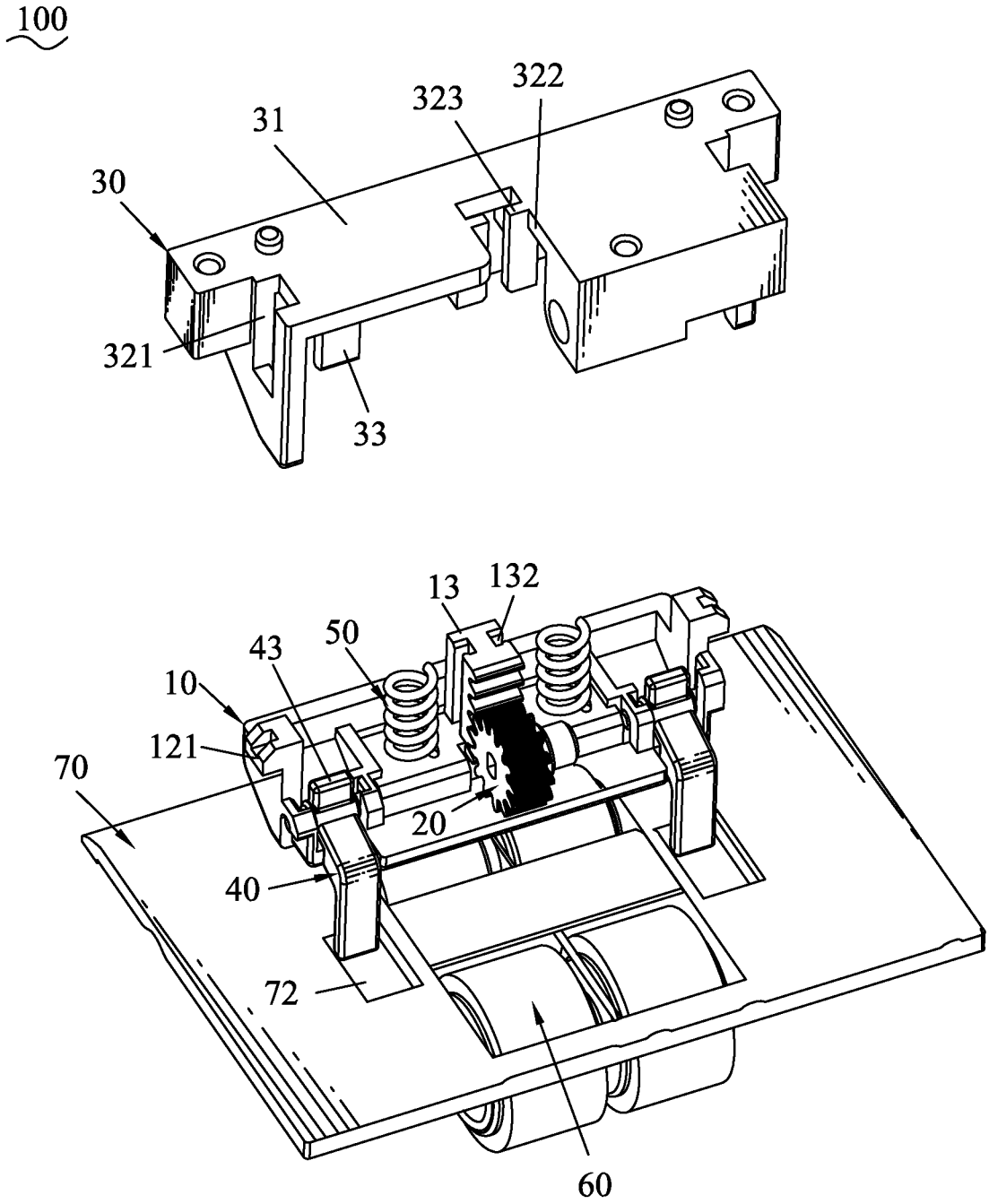
FIG. 2 is a perspective view of the pickup mechanism of FIG. 1, wherein a cover is moved away.

With reference to FIG. 1 and FIG. 2, a pickup mechanism 100 in accordance with an embodiment of the present invention is shown. The pickup mechanism 100 includes a paper pressing board 10, a drive assembly (not shown), a transmitting element 20, a cover 30, at least one stopper element 40, at least one elastic element 50, at least one pickup roller 60 and a mechanical frame 70. In this embodiment, the pickup mechanism 100 includes two stopper elements 40, two elastic elements 50 and four pickup rollers 60.

Figure 3:
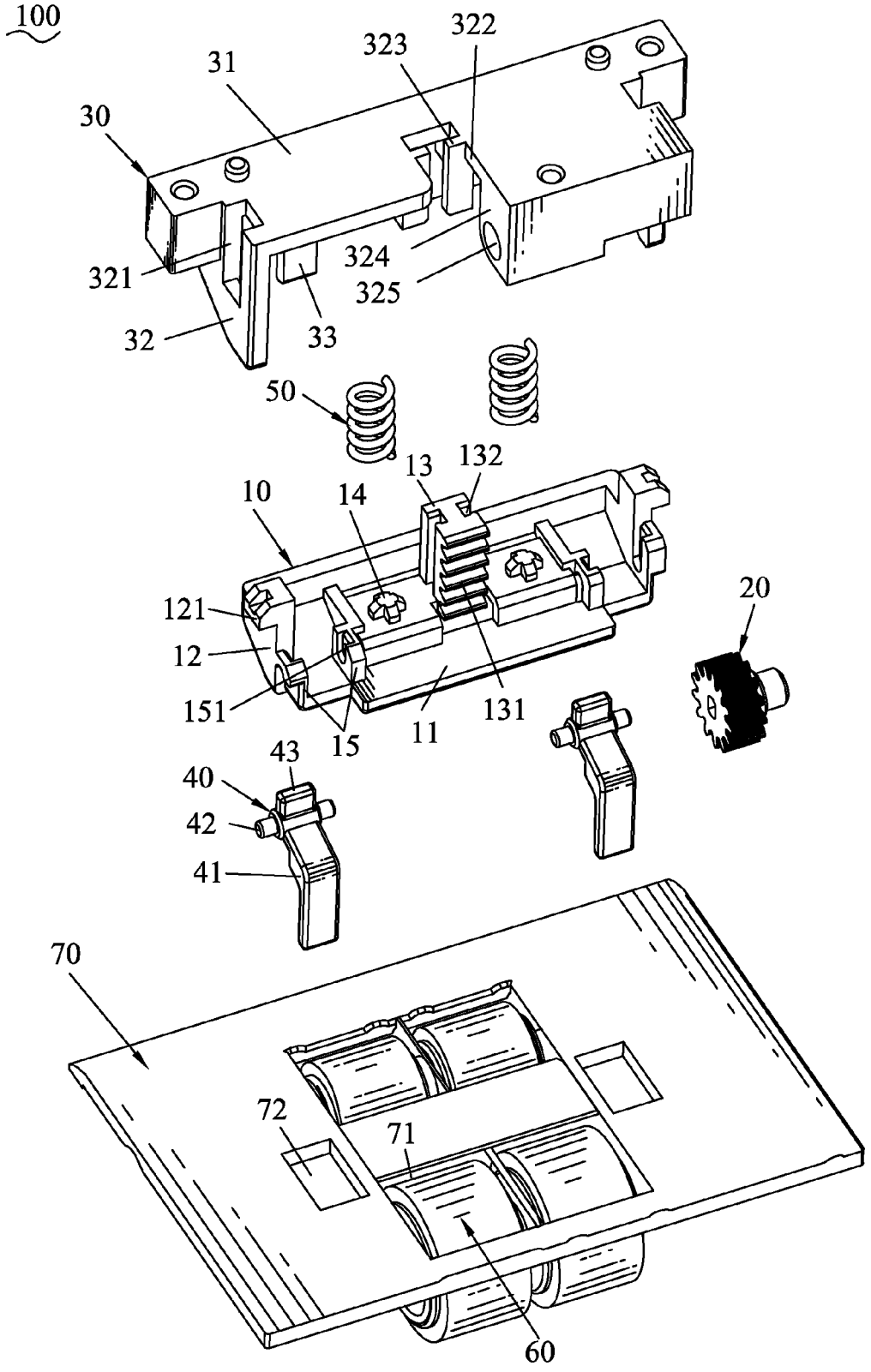
FIG. 3 is an exploded view of the pickup mechanism of FIG. 1.

Referring to FIG. 1 and FIG. 3, the paper pressing board 10 is disposed above the mechanical frame 70, and the paper pressing board 10 has a bottom board 11, and two side boards 12 extended upward from two rears of two opposite sides of the bottom board 11. Two tops of the two side boards 12 extend upward, and then protrude outward to form two limiting portions 121. A substantial middle of a top of the bottom board 11 of the paper pressing board 10 protrudes upward to form a movable portion 13. A front of the movable portion 13 defines a driven link 131. In this embodiment, the driven link 131 is a rack. Two opposite sides of the movable portion 13 of the paper pressing board 10 are concaved inward to form two guiding grooves 132 vertically penetrating therethrough. The top of the bottom board 11 of the paper pressing board 10 defines at least one buckling portion 14. Two portions of at least one side of a front of the bottom board 11 of the paper pressing board 10 protrude upward to form two fastening portions 15 spaced from each other. In this embodiment, two opposite sides of the top of the bottom board 11 of the paper pressing board 10 protrude upward to form two buckling portions 14 located at two opposite sides of the movable portion 13. Two portions of each side of the front of the bottom board 11 of the paper pressing board 10 protrude upward to form two fastening portions 15 spaced from each other. The fastening portion 15 defines a first pivoting hole 151 transversely penetrating therethrough.

Referring to FIG. 1 to FIG. 3, the cover 30 is covered on the paper pressing board 10, and the cover 30 has a top wall 31, and two lateral walls 32 extended downward from two opposite sides of the top wall 31. Two lateral walls 32 define two limiting grooves 321 transversely penetrating therethrough. The limiting portions 121 of the paper pressing board 10 are limited in the limiting grooves 321 and are capable of moving upward and downward in the limiting grooves 321. A middle of a front of the top wall 31 of the cover 30 is recessed rearward to form an opening 322. A top of the movable portion 13 of the paper pressing board 10 is capable of being received in the opening 322. Two inner surfaces of left and right sidewalls of the opening 322 protrude face to face and then extend downward to form two guiding blocks 323. The two guiding blocks 323 are guided in the two guiding grooves 132 of the paper pressing board 10. A front of the right sidewall of the opening 322 protrudes downward to form a fastening board 324. The fastening board 324 defines a second pivoting hole 325 transversely penetrating therethrough. The transmitting element 20 is pivotally assembled to the second pivoting hole 325 of the fastening board 324. In this embodiment, the transmitting element 20 is a gear. A bottom of the top wall 31 protrudes downward to form a locking part 33.

Referring to FIG. 1 and FIG. 3, the stopper element 40 is pivotally mounted to the paper pressing board 10. The stopper element 40 has an inverted L-shaped bent arm 41 with the mouth thereof being opened rearward and downward, and a top end thereof slantwise extending upward and rearward, two pivoting shafts 42 protruded oppositely from two opposite sides of a rear of the top end of the bent arm 41, and a locking portion 43 protruded upward from the rear of the top end of the bent arm 41 to be located between the two pivoting shafts 42. The pivoting shafts 42 of the stopper element 40 are correspondingly pivoted in the pivoting holes 151 of the fastening portions 15. The locking portion 43 of the stopper element 40 is capable of abutting against the locking part 33 to be locked to the locking part 33.

Referring to FIG. 2 and FIG. 3, the elastic element 50 is elastically disposed between the top wall 31 of the cover 30 and the bottom board 11 of the paper pressing board 10, and is worn around the buckling portion 14. In this embodiment, the elastic element 50 is a spring.

Referring to FIG. 3, the mechanical frame 70 of a board shape defines at least one locating groove 71 and at least one receiving groove 72. In this embodiment, the mechanical frame 70 defines four locating grooves 71 and two receiving grooves 72. The pickup roller 60 is disposed under the mechanical frame 70 and partially passed through the locating groove 71 to project above the mechanical frame 70. A bottom of the stopper element 40 is capable of being received in the receiving groove 72.

Referring to FIGS. 1-3, when the pickup mechanism 100 in accordance with the embodiment of the present invention is operated, the transmitting element 20 is driven by the drive assembly. The transmitting element 20 is cooperated with the driven link 131 of the paper pressing board 10 to bring along the paper pressing board 10 to be pressed downward or be raised up so as to make the pickup roller 60 generate a normal force for picking up paper and the stopper element 40 break away from the locking part 33 of the cover 30 or make the stopper element 40 abut against the locking part 33 of the cover 30 for realizing a paper blocking function.

An original status of the paper pressing board 10 shows a status of being raised up, and the elastic element 50 shows a compression status.

When the drive assembly shows a non-loaded status, the transmitting element 20 is capable of rotating freely, the paper pressing board 10 is pressed downward by virtue of an elastic force of the elastic element 50 to make the pickup roller 60 generate the normal force for picking up the paper. The stopper element 40 breaks away from a restraint of the locking part 33 with the paper pressing board 10 being pressed downward to make the stopper element 40 to move freely. The paper is fed to a scanning area (not shown) by virtue of the pickup roller 60 rotating along a first direction and pushing away the stopper element 40. The bottom of the stopper element 40 departs away from the receiving groove 72. A balanced down force is exerted on the paper by the paper pressing board 10 when the pickup roller 60 picks up the paper.

When there is no paper, the transmitting element 20 driven by the drive assembly rotates along a second direction opposite to the first direction. The paper pressing board 10 is raised up to the original position by virtue of the transmitting element 20 bringing along the driven link 131 of the paper pressing board 10. At the moment, the stopper element 40 rotates downward to abut against the locking part 33 of the cover 30 to be located at a paper blocking position on account of gravity or other external forces thereof. With the paper pressing board 10 being raised up, the paper blocking function of the stopper element 40 is realized by virtue of the constraint of the locking part 33. The bottom of the stopper element 40 is received in the receiving groove 72.

As described above, the transmitting element 20 brings along the paper pressing board 10 to be pressed downward or be raised up to make the pickup roller 60 generate the normal force for picking up the paper or the stopper element 40 realize the paper blocking function, comparing with the drive assembly driving the pickup assembly by way of the cam or the connecting rod in prior art, the pickup mechanism 100 will decrease corresponding transmission components and further ensure an assembling simplicity of the transmission components to decrease costs of assembling space and assembling hours, and furthermore a balanced down force exerted on the paper when the pickup roller 60 picks up the paper, so that the pickup mechanism 100 has a proper structural design. As a result, a stability of the pickup mechanism 100 is ensured.

What is claimed is:

1. A pickup mechanism, comprising:

a mechanical frame defining a first locating groove;

a first pickup roller disposed under the mechanical frame and partially passed through the first locating groove to project above the mechanical frame;

a paper pressing board disposed above the mechanical frame, and the paper pressing board having a bottom board, a top of the bottom board protruding upward to form a movable portion, a front of the movable portion defining a driven link;

a transmitting element cooperated with the driven link of the paper pressing board to bring along the paper pressing board to be pressed downward and be raised up;

a cover covered on the paper pressing board, and the cover having a top wall, a bottom of the top wall protruding downward to form a locking part;

at least one stopper element pivotally mounted to the paper pressing board; and a first elastic element elastically disposed between the cover and the paper pressing board, wherein the transmitting element is capable of rotating freely, the paper pressing board is pressed downward by virtue of an elastic force of the first elastic element to make the first pickup roller generate a normal force for picking up paper, the at least one stopper element breaks away from a restraint of the locking part with the paper pressing board being pressed downward to make the at least one stopper element to move freely, the paper is fed by virtue of the first pickup roller rotating and pushing away the at least one stopper element, and when there is no paper, the paper pressing board is raised up to an original position by virtue of the transmitting element bringing along the driven link of the paper pressing board, at the moment, the at least one stopper element rotates downward to abut against the locking part of the cover to be located at a paper blocking position on account of gravity or other external forces thereof, with the paper pressing board being raised up, the paper blocking function of the at least one stopper element is realized by virtue of the constraint of the locking part.

2. The pickup mechanism as claimed in claim 1, wherein the paper pressing board has two side boards extended upward from two rears of two opposite sides of the bottom board, two tops of the two side boards protrude outward to form two limiting portions, the cover has two lateral walls extended downward from two opposite sides of the top wall, two lateral walls define two limiting grooves transversely penetrating therethrough, the limiting portions are limited in the limiting grooves and are capable of moving upward and downward in the limiting grooves.

3. The pickup mechanism as claimed in claim 1, wherein a substantial middle of the top of the bottom board of the paper pressing board protrudes upward to form the movable portion, a middle of a front of the top wall of the cover is recessed rearward to form an opening, a top of the movable portion of the paper pressing board is capable of being received in the opening.

4. The pickup mechanism as claimed in claim 3, wherein two opposite sides of the movable portion of the paper pressing board are concaved inward to form two guiding grooves, two inner surfaces of left and right sidewalls of the opening protrude face to face and then extend downward to form two guiding blocks guided in the two guiding grooves of the paper pressing board.

5. The pickup mechanism as claimed in claim 3, wherein a front of right sidewall of the opening protrudes downward to form a fastening board, the fastening board defines a pivoting hole, the transmitting element is pivotally assembled to the pivoting hole of the fastening board.

6. The pickup mechanism as claimed in claim 5, wherein two portions of at least one side of a front of the bottom board of the paper pressing board protrude upward to form two fastening portions spaced from each other, the two fastening portions each defines an another pivoting hole, the at least one stopper element has an inverted L-shaped bent arm with the mouth thereof being opened rearward and downward, and a top end thereof slantwise extending upward and rearward, two pivoting shafts protruded oppositely from two opposite sides of a rear of the top end of the bent arm, and a locking portion protruded upward from the rear of the top end of the bent arm to be located between the two pivoting shafts, the pivoting shafts are correspondingly pivoted in the another pivoting holes of the fastening portions, the locking portion is capable of abutting against the locking part to be locked to the locking part.

7. The pickup mechanism as claimed in claim 6, wherein two portions of each side of the front of the bottom board of the paper pressing board protrude upward to form two fastening portions spaced from each other, the pickup mechanism includes two stopper elements, the pivoting shafts of the at least one stopper element are correspondingly pivoted in the another pivoting holes of the fastening portions, the locking portion of the at least one stopper element is capable of abutting against the locking part to be locked to the locking part.

8. The pickup mechanism as claimed in claim 1, wherein the top of the bottom board of the paper pressing board defines at least one buckling portion, the first elastic element is elastically disposed between the top wall of the cover and the bottom board of the paper pressing board, and is worn around the at least one buckling portion.

9. The pickup mechanism as claimed in claim 8, wherein two opposite sides of the top of the bottom board of the paper pressing board protrude upward to form two buckling portions located at two opposite sides of the movable portion, the pickup mechanism includes the first elastic element and a second elastic element, and each of the first elastic element and the second elastic element is elastically disposed between the top wall of the cover and the bottom board of the paper pressing board, and is worn around the at least one buckling portion.

10. The pickup mechanism as claimed in claim 1, wherein the mechanical frame defines at least one receiving groove, a bottom of the at least one stopper element is capable of being received in the at least one receiving groove.

11. The pickup mechanism as claimed in claim 10, wherein the mechanical frame defines two receiving grooves, the pickup mechanism includes two stopper elements, the bottom of at least one of the stopper elements is capable of being received in at least one of the receiving grooves.

12. The pickup mechanism as claimed in claim 1, wherein the mechanical frame further comprises a second locating groove, a third locating groove and a fourth locating groove, the pickup mechanism further comprises a second pickup roller, a third pickup roller and a fourth pickup roller, wherein one of the first, second, third and fourth pickup roller is disposed under the mechanical frame and partially passed through one of the first, second, third and fourth locating groove to project above the mechanical frame.

13. The pickup mechanism as claimed in claim 1, wherein the driven link is a rack.

14. The pickup mechanism as claimed in claim 1, wherein the transmitting element is a gear.

15. The pickup mechanism as claimed in claim 1, wherein the first elastic element is a spring.

* * * * *